US006073268A

United States Patent [19]

Ziegler et al.

[11] Patent Number: 6,073,268

[45] Date of Patent: Jun. 13, 2000

[54] EXPANDABLE JACKET

[76] Inventors: Chad E. Ziegler, 504 Catherine St., Philadelphia, Pa. 19147; William R. Richter, 220 W. Rittenhouse Sq., #8B, Philadelphia, Pa. 19103

[21] Appl. No.: 09/257,668

[22] Filed: Feb. 25, 1999

[51] Int. Cl.[7] ..... A41D 10/00; A41D 1/00; A41D 1/02

[52] U.S. Cl. ..... 2/94; 2/108; 2/84

[58] Field of Search ..... 2/94, 108, 84, 2/85, 87, 88, 92, 93

[56] References Cited

U.S. PATENT DOCUMENTS

| | | | |
|---|---|---|---|
| 2,150,171 | 3/1939 | Kolly . | |
| 2,507,322 | 5/1950 | Smith . | |
| 2,682,056 | 6/1954 | Werber . | |
| 4,068,314 | 1/1978 | Yellen et al. | 2/94 |
| 4,151,616 | 5/1979 | Larsen | 4/617 |
| 4,307,470 | 12/1981 | Ezell | 2/108 |
| 4,502,154 | 3/1985 | Itoi | 2/108 |
| 4,864,654 | 9/1989 | Schriver et al. | 2/84 |
| 4,949,401 | 8/1990 | Kinsey, Jr. | 2/102 |
| 5,123,117 | 6/1992 | Prendergast | 2/108 |
| 5,452,476 | 9/1995 | Jenks | 2/46 |
| 5,699,560 | 12/1997 | Greenberg | 2/94 |
| 5,860,164 | 1/1999 | Johnson | 2/94 |

OTHER PUBLICATIONS

"Red Ledge"™ Package Insert Description for a Backpacking Long Poncho.

*Primary Examiner*—John J. Calvert
*Assistant Examiner*—Shirra L. Jenkins
*Attorney, Agent, or Firm*—William R. Richter

[57] ABSTRACT

An expandable jacket that both (1) can protect a bag or knapsack worn by a user as well as the user and (2) can simulate a conventional jacket when the user is not wearing a knapsack, comprises a conventional racket and extra material affixed to the conventional jacket. Preferably, the extra material is unnecessary to the jacket's ability to be worn as a conventional jacket protecting a user from the elements, but is used to aid in allowing the expandable jacket to protect the user from the elements as well as a knapsack worn by the user. Preferably, the extra material is affixed to the rear of the jacket so that it can protect the knapsack worn by the user is worn on the user's back. When in an open mode, the extra material allows the rear of the jacket to expand to provide additional volume to the interior of the expandable jacket. When in a closed mode, the expandable jacket can be worn as a conventional jacket by the user. Preferably, the expandable jacket of the present invention further comprises a closure situated on the rear of the jacket to keep the jacket in its closed mode when the closure is in its closed position and allowing the expandable jacket to expand to its open position when the closure is in its open position.

19 Claims, 6 Drawing Sheets

EXPANDABLE JACKET

The invention relates generally to garments, and more particularly, relates to jackets for a user wearing a knapsack, backpack or other article worn on the back.

BACKGROUND OF THE INVENTION

Rainwear, or more particularly, rain jackets have been used for many years. Typically, rain jackets are made of a waterproof material or made of a conventional material and layered with a waterproof coating. Common waterproof materials used to manufacture rain wear include rubber or state-of-the-art materials such as GORE-TEX® or similar alternative. Waterproof-coated rainwear is typically made of nylon or similar fabric and coated with an outer layer of waterproof coating such as poly-vinyl chloride (PVC).

Rain jackets enable users to venture outdoors in the rain, snow or sleet without the use of umbrellas and without getting wet. Users of rain jackets include school children, hikers, and everyday joggers and walkers. One aspect of each of these groups, and especially school children and hikers, is that they carry knapsacks (or day packs or backpacks) to hold some of their belongings. It is, therefore, desirable to provide a jacket that people who wear knapsacks can use to protect themselves from the elements as well as their knapsacks.

One conventional article of clothing that people have used to cover themselves and their knapsack are ponchos, which basically are large sheets having a hole for one's head and possibly slots for one's arms. Consequently, ponchos are worn quite loosely over the body, and therefore, can cover a knapsack as well as the user.

Unfortunately, because the basic premise of poncho design is its simplicity, ponchos are cumbersome to use and often ineffective. Ponchos leave a large amount of material hanging loose on the body or dangling from the user's body. For this reason, windy conditions, which usually accompany inclement weather or precipitation, can render a poncho useless for protecting a wearer from the elements. Further, because ponchos are worn loosely on the body, the material can impede mobility, especially when walking through dense flora. Accordingly, ponchos work their best when one is standing still, but do not work well when the user is moving. It is, therefore, desirable to provide an article of clothing that people can wear to protect themselves and their knapsacks from the elements, yet is less cumbersome and more effective than a poncho.

Rain jackets are far less cumbersome and much more effective than ponchos, but cannot be used to also protect a knapsack worn by the user from the elements. It is, therefore, desirable to provide a jacket that people who wear knapsacks can use to protect their knapsack from the elements as well as themselves. Because people who use knapsacks often wear jackets when not wearing their knapsacks, it also is desirable to provide a jacket that both (1) can protect a knapsack as well as the user and (2) can simulate a conventional jacket when the user is not wearing a knapsack.

SUMMARY OF THE INVENTION

An expandable jacket that both (1) can protect a bag or knapsack worn by a user as well as the user and (2) can simulate a conventional jacket when the user is not wearing a knapsack, is provided. The expandable jacket comprises a conventional jacket and extra material affixed to the conventional jacket. In a preferred embodiment, the extra material is unnecessary to the jacket's ability to be worn as a conventional jacket protecting a user from the elements.

The extra material is used to aid in allowing the expandable jacket to protect the user from the elements as well as a knapsack worn by the user. In certain preferred embodiments, the extra material is detachably affixed to the jacket. Preferably, the extra material is affixed to the rear of the jacket so that it can protect the knapsack worn by the user on the user's back.

When in a closed mode, the expandable jacket has an interior having a first volume. When in an open mode, the extra material allows the rear of the jacket to expand to provide additional volume to the interior of the expandable jacket. The interior of the expandable jacket in the open mode has a second volume that is greater than the first volume. When in the closed mode, the expandable jacket can be worn as a conventional jacket by the user, and when in the open mode, the expandable jacket can be used by the user to protect the user from the elements as well as the knapsack worn by the user.

In another preferred embodiment, the expandable jacket of the present invention further comprises a closure situated on the rear of the jacket. The closure has an open position and a closed position such that when the closure is in the closed position, the expandable jacket is in its closed mode, and when the closure is in the open position, the expandable jacket may expand to its open position.

In a preferred embodiment, the closure is a zipper. In other preferred embodiments, the closure is VELCRO® hook and loop fasteners or a series of snaps. Preferably, when the jacket is viewed from the rear, the closure has a substantially U shape.

In a certain preferred embodiment, when the extra material provides additional volume to the expandable jacket, the additional volume is a second volume separate from the first volume. In this embodiment, when in the open mode, the second volume is used to protect the bag worn by the user. In one version of this embodiment, the expandable jacket has a collar situated on the top of the jacket and the collar has an interior. In this version, when the expandable jacket is in the closed mode, the extra material is contained in the interior of the collar, and when the expandable jacket is in the open mode, the extra material is situated over the knapsack worn by the user such that the knapsack is substantially covered by the extra material. Preferably, a closure similar to that situated on the rear of the jacket (as described above) is situated on the collar.

In another preferred embodiment, the extra material is part of the rear of the expandable jacket. This embodiment comprises at least one drawstring contained by the rear of the expandable jacket that is used to transform the jacket from the closed mode to the open mode or from the open mode to the closed mode. When the drawstring is in a relaxed state, the expandable jacket is in the open mode, and when the drawstring is taught, the expandable jacket is in the closed mode. Preferably, this embodiment of the expandable jacket further comprises a sheath attached to the rear of the expandable jacket for containing the drawstring. The sheath may be discontinuous such that it is comprised of a plurality of segments. In addition, the drawstring preferably is elastic.

DETAILED DESCRIPTION OF THE PREFERRED EMBODIMENT

The present invention provides an expandable jacket that both (1) can protect a knapsack worn by a user as well as the user and (2) can simulate a conventional jacket when the user is not wearing a knapsack. Although the following description illustrates the present invention in protecting a knapsack from the elements, the expandable jacket of the present invention can protect any article worn over the shoulders of a user or carried by the user next to the body.

Figure 1:
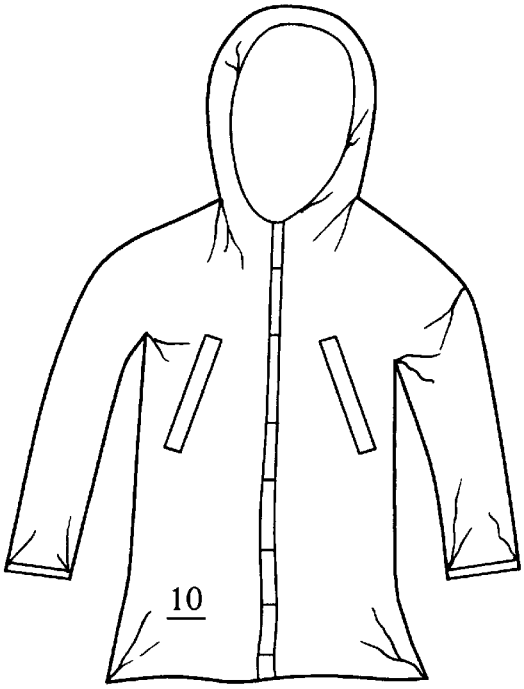
FIG. 1 is a front view of a preferred embodiment of the jacket of the present invention.
Figure 2:
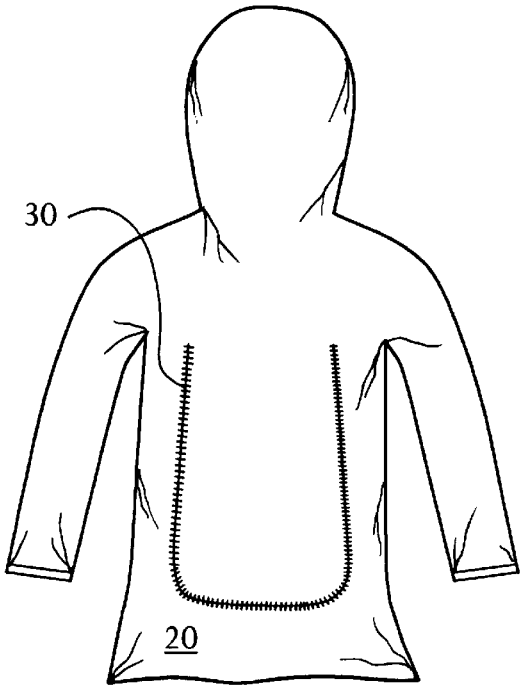
FIG. 2 is a rear view of the expandable jacket of FIG. 1.
Figure 3:
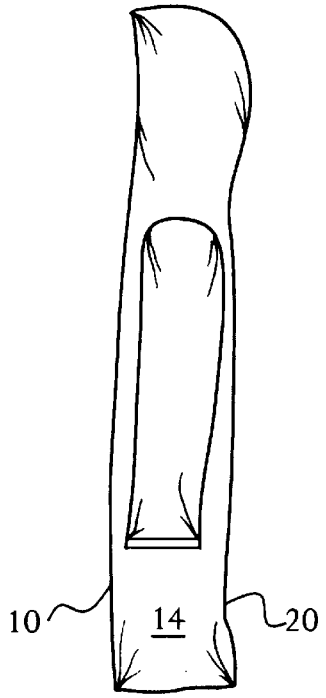
FIG. 3 is a side view of the expandable jacket of FIG. 1 in its closed mode.

FIG. 1 shows a front view of a preferred embodiment of an expandable jacket according to the present invention. FIG. 2 shows a rear view of the expandable jacket of FIG. 1. From the rear 20, the appearance of the expandable jacket is similar to a conventional jacket except for a zipper 30. As shown in FIG. 2, the expandable jacket is in its closed mode, i.e., for use by a user not wearing a knapsack. FIG. 3 shows a side view of the expandable jacket in its closed mode. From the side 14, the expandable jacket has the same appearance as that of a conventional jacket. From the front 10, the expandable jacket has the same appearance as that of a conventional jacket.

Figure 5:
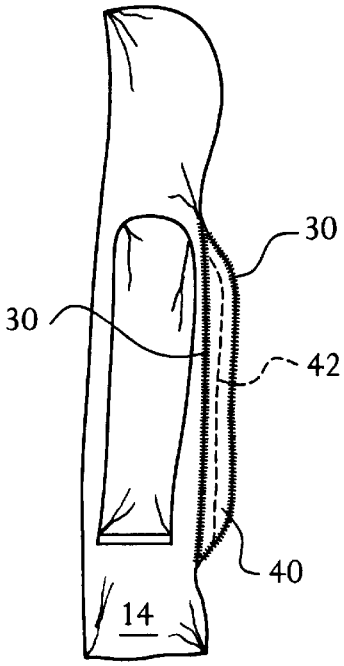
FIG. 5 is a side view of the expandable jacket of FIG. 1 in a partially-open state.
Figure 4:
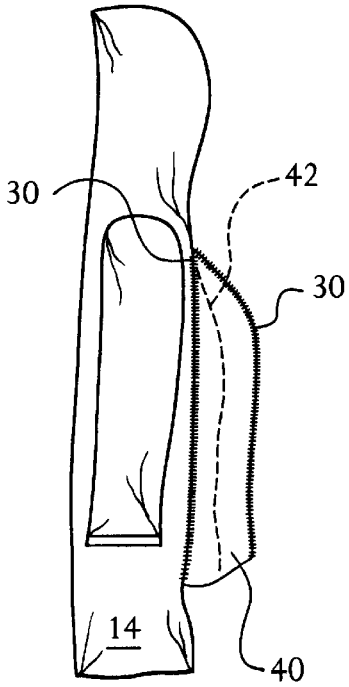
FIG. 4 is a side view of the expandable jacket of FIG. 1 in its open mode.

FIG. 4 shows a side view of the expandable jacket in its open mode, i.e., for use when the user is wearing a knapsack. During operation, the expandable jacket transforms from the jacket of FIGS. 2 and 3 into the jacket of FIG. 4 as follows. As shown in FIG. 2, the zipper 30 is "un-zipped" or opened to reveal extra material 40. FIG. 5 shows the expandable jacket in a partially-open state, i.e., between the open mode and the closed mode. As the expandable jacket expands, the extra material 40 expands so that room is created to accommodate a knapsack under the jacket. When the expandable jacket is in its fully-opened mode, it appears as shown in FIG. 4.

Figure 6:
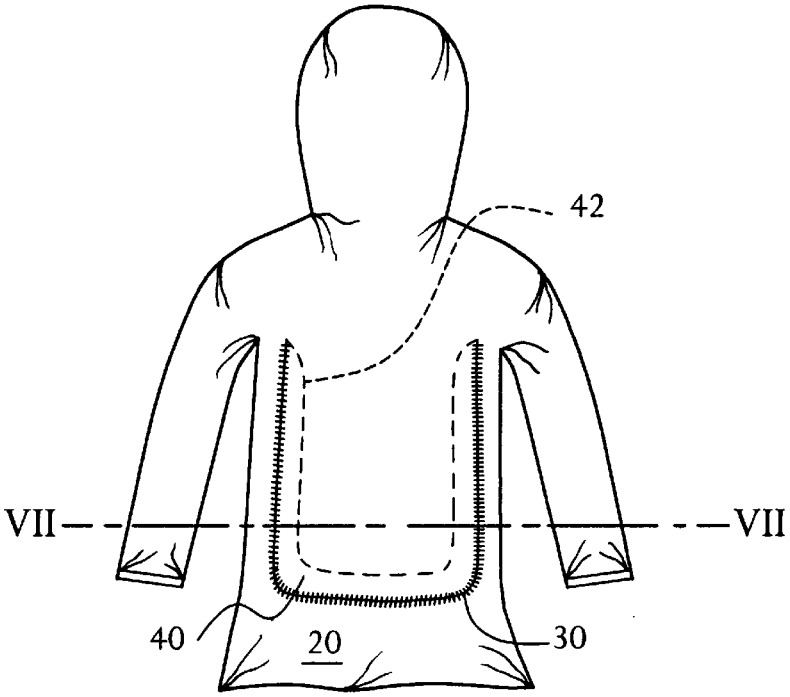
FIG. 6 is a rear view when the expandable jacket of FIG. 1 in its closed mode.
Figure 7:
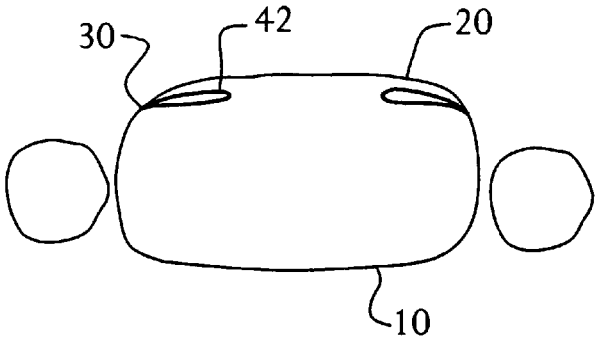
FIG. 7 is a cross-sectional view across section VII—VII of the expandable jacket of FIG. 6.

When the expandable jacket is in its closed mode as shown in FIG. 2, the extra material 40 is folded inwardly and upon itself "accordion style." FIG. 6 shows a rear view of the expandable jacket and FIG. 7 shows a cross-sectional view across section VII—VII of the expandable jacket of FIG. 6. Both FIGS. 6 and 7 illustrate the positioning of the extra material 40 when the expandable jacket is in its closed mode. After the user removes the knapsack, the user merely "zips-up" or closes the zipper 30 to place the expandable jacket back in its closed mode, as shown in FIGS. 2, 3 or 6.

As shown FIGS. 4–7, the extra material folds along fold-line 42, which preferably is substantially equidistant from both of the mating sides of the zipper 30. Preferably, the rear 20 of the expandable jacket is biased so as to naturally fold only along the fold-line 42. In the preferred embodiment of the expandable jacket of FIGS. 1–6, the zipper 30 may take another, yet equivalent form. For example, VELCRO® hook and loop fasteners or a series of snaps may replace the zipper 30.

Figure 2A:
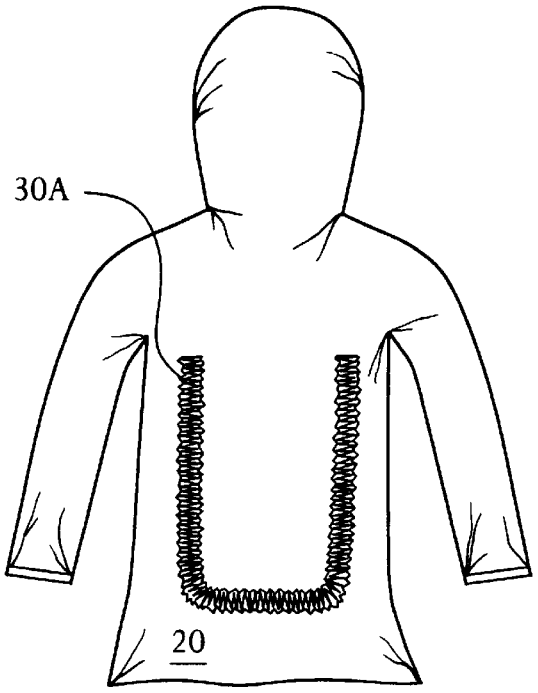
FIG. 2A is a rear view of a variation of the expandable jacket of FIG. 1 in its closed mode.
Figure 4A:
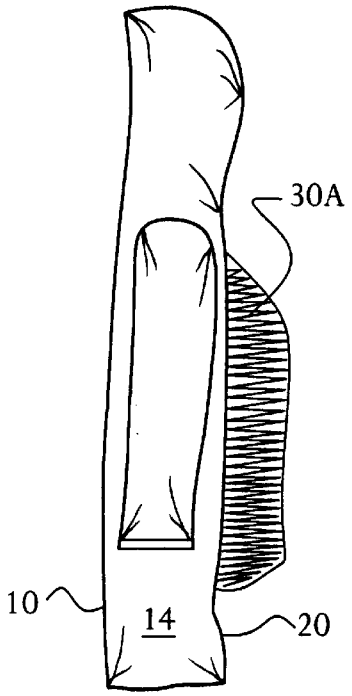
FIG. 4A is a side view of the expandable jacket of FIG. 2A in its open mode.

A variation on the embodiment of FIGS. 1–7 may utilize stretchable material 30A on the rear 20 of the jacket in place of and in approximately the same location as the zipper 30. A rear view of this variation of the expandable jacket in its closed mode is shown in FIG. 2A and a side view of this variation of the expandable jacket is shown in FIG. 4A. The stretchable (or elastic) material 30A will be able to stretch so that the rear 20 of the jacket can cover a knapsack in its open mode, and revert back to its closed mode when the user is not wearing a knapsack. A side view of this variation of the expandable jacket in its closed mode is the same as that of the expandable jacket of FIGS. 1–7, i.e., as shown in FIG. 3.

Figure 8:
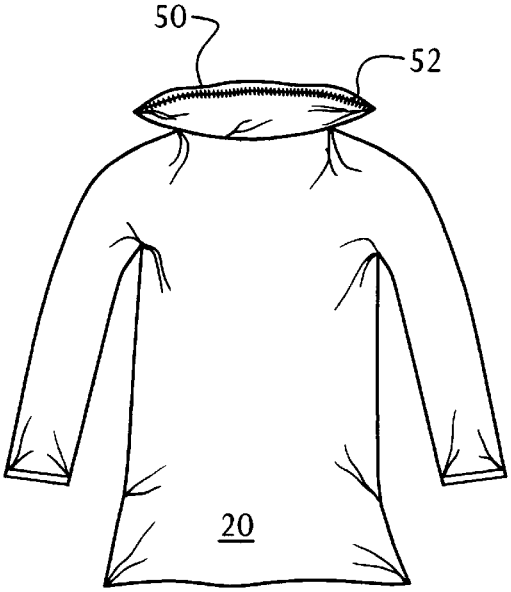
FIG. 8 is a rear view of another preferred embodiment of the expandable jacket in its closed mode.

Another preferred embodiment of the expandable jacket of the present invention is shown in FIGS. 8–11. FIG. 8 shows a rear view of this additional preferred embodiment of the present invention in its closed mode. From the rear 20, the appearance of the expandable jacket of FIG. 8 is similar to a conventional jacket having a collar 50. As is conventional, a hood 60 may be folded and contained inside the collar 50 of the expandable jacket of FIG. 8.

Figure 10:
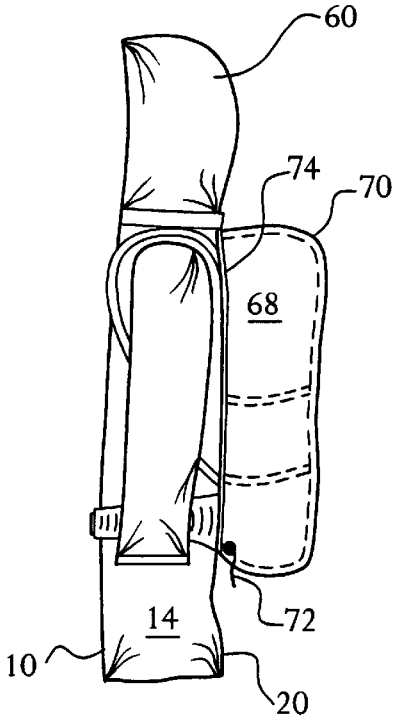
FIG. 10 is a side view of the expandable jacket of FIG. 8 in its open mode.
Figure 9:
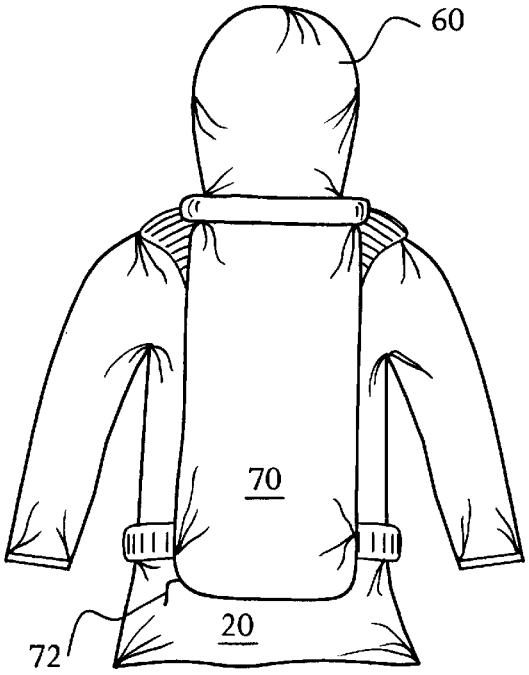
FIG. 9 is a rear view of the expandable jacket of FIG. 8 in its open mode.

The collar 50 of the expandable jacket of FIG. 8, however, also has extra material 70 folded inside it to cover a backpack 68. FIG. 9 shows a rear view, and FIG. 10 shows a side view, of the expandable jacket of FIG. 8 in its open mode. Preferably, the extra material 70 is a conventional pack fly 70 that covers a backpack 68, except it is attached to material on the inside of the collar 50. As is conventional, the pack fly 70 may have an elastic drawstring 72 for cinching the pack fly 70 snug around the backpack 68. The drawstring 72 is situated in a groove 74 (or sheath of material) on the outer edge of the pack fly 70 (adjacent the user's back when covering a backpack 68).

Figure 11:
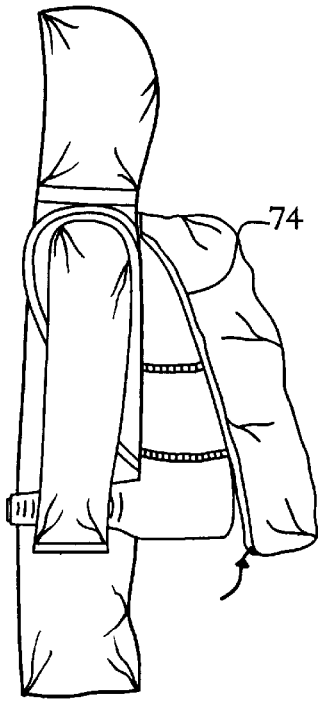
FIG. 11 is a side view of the expandable jacket of FIG. 8 in a partially-open state.

During operation, the expandable jacket of FIG. 8 transforms from the jacket of FIG. 8 into the jacket of FIGS. 9 and 10 as follows. The collar 50 is opened by "un-zipping" the zipper 52 to reveal the hood 60 and the pack fly 70. FIG. 11 shows a side view of the expandable jacket in a partially-open state, i.e., between the open mode and the closed mode. As the pack fly 70 is unfolded from the hood 50, it is manually placed over the user's backpack 68. Variations on the embodiment of FIGS. 8–11 may enclose the pack fly 70 in an area on the expandable jacket other than the collar 50, such as in a zipper compartment on the upper back of the jacket.

Figure 12:
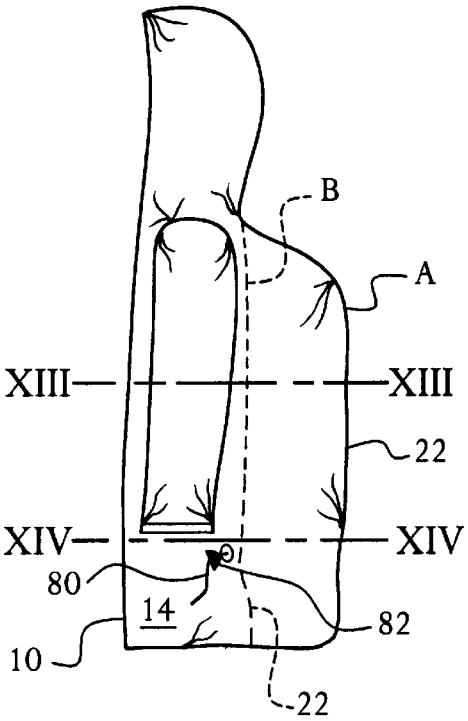
FIG. 12 is a side view of another preferred embodiment of the expandable jacket present invention.

Another preferred embodiment of the expandable jacket of the present invention is shown in FIGS. 12–14B. FIG. 12 shows a side view of this additional preferred embodiment of the present invention. Solid line A depicts the rear 22 of the jacket when the expandable jacket is in its open mode, while phantom line B depicts the rear 22 of the jacket when the expandable jacket is in its closed mode. The expandable jacket of FIG. 12 utilizes a conventional elastic drawstring 80 that is used in many jackets to cinch the waist or hem of the jacket snug against the wearer.

Figure 13:
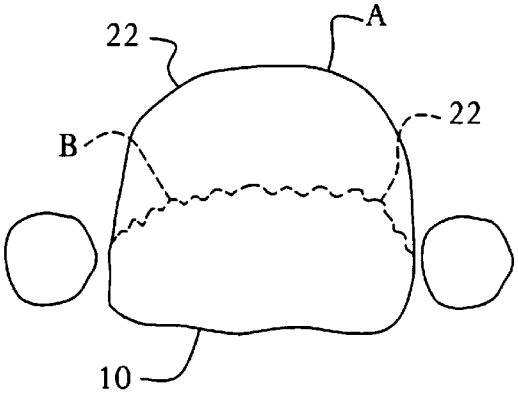
FIG. 13 is a cross-sectional view of the expandable jacket of FIG. 12 across section XIII—XIII.
Figure 14A:
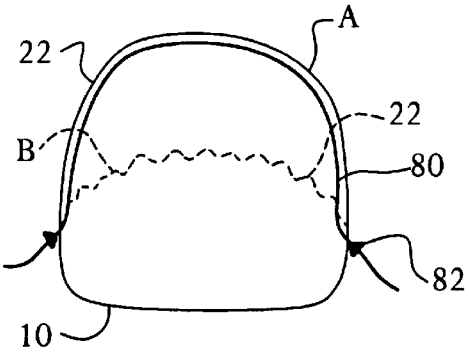
FIG. 14A is a cross-sectional view of the expandable jacket of FIG. 12 across section XIV—XIV.

FIG. 13 shows a cross-sectional view of the expandable jacket of FIG. 12 across section XIII—XIII and FIG. 14A shows a cross-sectional view of the expandable jacket of FIG. 12 across section XIV—XIV. As in FIG. 12, the solid line A in FIGS. 13 and 14A depicts the rear 22 of the jacket when the expandable jacket is in its open mode and phantom line B depicts the rear 22 of the jacket when the expandable jacket is in its closed mode.

Figure 14B:
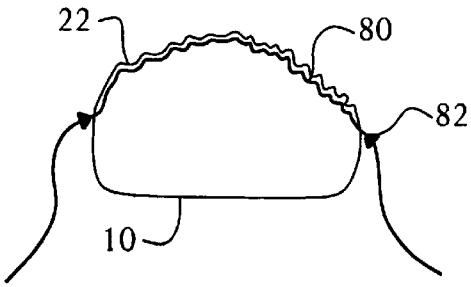
FIG. 14B is a cross-sectional view of the expandable jacket of FIG. 12 across section XIV—XIV in its closed mode.

As shown in FIG. 14A, the elastic drawstring 80 is in its relaxed state, and the rear 22 of the jacket is fully expanded to accommodate a knapsack or backpack worn by the user. After the user removes the knapsack, the user merely tightens the drawstring 80 by loosening the latch 82 and pulling the drawstring 80 at each end to place the expandable jacket in its closed mode, as shown in FIG. 14B. Such latch 82 is conventional and merely functions to allow the drawstring 80 to pass through without restriction or to lock the drawstring 80 in a fixed position.

Preferably, as shown in FIGS. 12–14B, the drawstring 80 extends from one side 14 to the other side 14 and along the rear 22 of the expandable jacket only. Preferably, the drawstring 80 is situated in a sheath of material at approximately the waist of the user, although the drawstring may be situated at a different height such as the hem. Multiple drawstrings, such as at both the waist and the hem also may be used. As shown in FIG. 14B, the rear 22 of the expandable jacket folds upon itself similar to that of an accordion. This uneven surface of the rear 22 results because the drawstring 80 is situated in the sheath along the entire rear 22 of the jacket. When the drawstring 80 is pulled taught, the material constituting the rear 22 of the jacket is pulled inward and placed into a space smaller than it occupies when the jacket is expanded.

Figure 16:
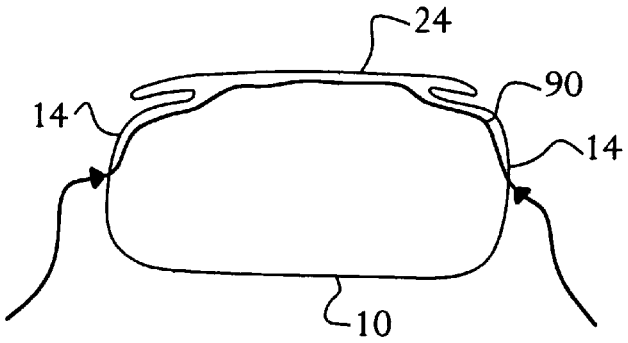
FIG. 16 is a cross-sectional view across the waist of the expandable jacket of FIG. 15 in its closed mode.
Figure 15:
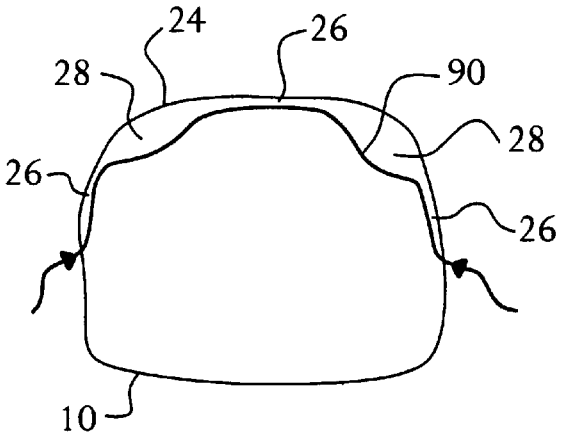
FIG. 15 shows a cross-sectional view across the waist of another preferred embodiment of the expandable jacket in its open mode.

Another preferred embodiment of the expandable jacket of the present invention is a variation on the preferred embodiment of FIGS. 12–14B. This additional preferred embodiment is illustrated in FIGS. 15 and 16. FIG. 15 shows a cross-sectional view of the expandable jacket across the waist (section XIV—XIV of FIG. 12) and FIG. 16 shows the same cross-sectional view of the expandable jacket in its closed mode.

As illustrated in FIG. 15, an elastic drawstring 90 is situated in a sheath along the rear 24 of the expandable jacket, but not the entire rear 24 as in the embodiments of FIGS. 12–14B. In FIG. 15, the drawstring 90 is in the sheath in areas 26, but not in areas 28, where the drawstring 90 is free from the confines of the sheath. Because of the discontinuous sheath, when the drawstring 90 is pulled taught, the material constituting the rear 24 of the jacket is pulled inward, but does not pinch together as shown in FIG. 14B. As shown in FIG. 16, the drawstring 90 is pulled taught and the rear 24 of the jacket in areas 28 moves toward the sides 14 of the jacket when the sheath segments in areas 26 tend to move toward each other. Preferably, the rear 24 of the expandable jacket in areas 28 is biased so as to naturally fold toward the back of the user.

As with the preferred embodiments of FIGS. 12–14B, the drawstring 90 preferably is situated in the discontinuous sheath of material at approximately the waist of the user, although the drawstring may be situated at a different height such as the hem. Multiple drawstrings, such as at both the waist and the hem also may be used. Variations on the embodiment of FIGS. 15 and 16 may utilize other forms of a discontinuous sheath. That is, the sheath may vary in the number of segments (areas 26). In this way, the drawstring 90 may simulate a belt and the sheath may simulate belt loops on the inside of the jacket with many short segments.

The expandable jacket of the present invention allows people who wear knapsacks to use one garment to protect their knapsack from the elements as well as themselves. In addition, the expandable jacket is not cumbersome to use and because of its well-fitting, yet expandable qualities, it will securely protect the user and the user's knapsack when required, in rough weather conditions such as high winds.

A particular advantage of the expandable jacket of the present invention is that it can be in its open mode to protect a user and their knapsack while the knapsack is worn on the user's shoulders. In this way, the user can continue to support the weight of the knapsack and the knapsack's contents in its intended fashion. Another advantage of the expandable jacket is its ease of use. For all of the embodiments described, if the user is not yet wearing the jacket, the user need not remove the knapsack from their shoulders to protect the knapsack from the elements. In addition, for the embodiment of FIGS. 8–11, if the user is already wearing the jacket, the user need not remove the knapsack from their shoulders to protect knapsack from the elements.

It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of parts within the principles of the invention to the full extent indicated by the broad general meaning of the terms in which the appended claims are expressed.

We claim:

1. An expandable jacket comprising:

a jacket having a volume and having extra material, said extra material being unnecessary to the jacket's ability to be worn as a jacket protecting a user from the elements, and said extra material being configured for allowing the jacket to increase in overall volume and thereby protect the user and a bag worn by the user from the elements.

2. The expandable jacket of claim 1, wherein:

said extra material is detachably affixed to the jacket.

3. The expandable jacket of claim 1, wherein:

the jacket has a rear;

the bag worn by the user is worn on the user's back; and said extra material is affixed to the rear of the jacket.

4. The expandable jacket of claim 3, wherein:

the jacket has an interior;

when in a closed mode, the interior of the expandable jacket has a first volume; and when in an open mode, said extra material allows the rear of the jacket to expand to provide additional volume to the interior of the expandable jacket, said interior of the expandable jacket in the open mode having a second volume, the second volume being greater than the first volume;

such that when in the closed mode, the expandable jacket can be worn as a conventional jacket by the user, and when in said open mode, the expandable jacket can be used by the user to protect the user from the elements as well as the bag worn by the user.

5. The expandable jacket of claim 4 further comprising a closure, said closure situated on the rear of the jacket and having an open position and a closed position, such that when said closure is in said closed position, the expandable jacket is in its closed mode, and when said closure is in said open position, the expandable jacket may expand to its open position.

6. The expandable jacket of claim 5, wherein said closure is a zipper.

7. The expandable jacket of claim 5, wherein when the jacket is viewed from the rear, said closure has a substantially U shape.

8. The expandable jacket of claim 1, wherein:

the jacket has a rear;

the bag worn by the user is worn on the user's back and partially covers the rear of the jacket;

when in a closed mode, the expandable jacket has an interior having a first volume;

when in an open mode, said extra material provides additional volume to the expandable jacket, said additional volume being a second volume and being separate from the first volume; and such that when in said closed mode, the expandable jacket can be worn as a conventional jacket by the user, and when in said open mode, the expandable jacket can be used by the user to protect the user from the elements as well as the bag worn by the user, the second volume being used to protect the bag worn by the user.

9. The expandable jacket of claim 8 further comprising a top and a collar situated on the top of the jacket, said collar having an interior such that:

when the expandable jacket is in said closed mode, said extra material is contained in the interior of said collar; and when the expandable jacket is in said open mode, the extra material is situated over the bag worn by the user such that the bag is substantially covered by the extra material.

10. The expandable jacket of claim 9 further comprising a closure, said closure situated on the collar of the jacket and having an open position and a closed position, such that when said closure is in said closed position, the expandable jacket is in its closed mode, and when said closure is in said open position, the expandable jacket may expand to its open position.

11. The expandable jacket of claim 10, wherein said closure is a zipper.

12. The expandable jacket of claim 9 further comprising a hood for covering the user's head that is contained in the interior of the collar when said closure is in its closed position, and when said closure is in said open position, the hood may be extended to cover the user's head.

13. The expandable jacket of claim 8, wherein:

said extra material is detachably affixed to the jacket.

14. The expandable jacket of claim 1, wherein:

the jacket has a rear; and the extra material is integral with the rear of the expandable jacket.

15. The expandable jacket of claim 1, wherein:

the jacket has a rear and an interior; and when in a closed mode, the interior of the expandable jacket has a first volume;

when in an open mode, said extra material allows the rear of the jacket to expand to provide additional volume to the interior of the expandable jacket, said interior of the expandable jacket in the open mode having a second volume, the second volume being greater than the first volume; and the jacket further comprises:

at least one drawstring contained by the rear of the expandable jacket and used to transform the jacket from the closed mode to the open mode or from the open mode to the closed mode, wherein when the drawstring is in a relaxed state, the expandable jacket is in the open mode, and when the drawstring is taught, the expandable jacket is in the closed mode.

16. The expandable jacket of claim 15 further comprising a sheath attached to the rear of the expandable jacket for containing the drawstring.

17. The expandable jacket of claim 16, wherein the sheath is discontinuous such that it is comprised of a plurality of segments.

18. The expandable jacket of claim 15, wherein the drawstring is elastic.

19. An expandable jacket comprising:

material being used to aid in allowing the expandable jacket to protect the user from the elements as well as an article carried by the user, wherein the jacket has a rear and interior and wherein:

when in a closed mode, the interior of the expandable jacket has a first volume;

when in an open mode, said material allows the rear of the jacket to expand to provide additional volume to the interior of the expandable jacket, said interior of the expandable jacket in the open mode having a second volume, the second volume being greater than the first volume;

such that when in the closed mode, the expandable jacket can be worn as a conventional jacket by the user, and when in said open mode, the expandable jacket can be used by the user to protect the user from the elements as well as the article carried by the user.

* * * * *